US007887247B2

(12) United States Patent
Kim

(10) Patent No.: US 7,887,247 B2
(45) Date of Patent: Feb. 15, 2011

(54) UNDERGROUND EARTH RETENTION STRUT CONSTRUCTION METHOD USING HORIZONTAL FRAME STRUCTURE

(75) Inventor: Kwang-Man Kim, Seoul (KR)

(73) Assignee: Baro Construction Key-Technology Co., Ltd., Seoul (KR)

( * ) Notice: Subject to any disclaimer, the term of this patent is extended or adjusted under 35 U.S.C. 154(b) by 546 days.

(21) Appl. No.: 11/535,708

(22) Filed: Sep. 27, 2006

(65) Prior Publication Data

US 2008/0075540 A1 Mar. 27, 2008

(51) Int. Cl.
*E04B 1/24* (2006.01)

(52) U.S. Cl. ..... 403/173; 403/170; 403/171; 403/174; 52/663; 52/169.9; 52/653.1; 405/272; 405/282; 405/283

(58) Field of Classification Search ..... 405/282, 405/272, 283; 403/169–178; 52/204.61, 52/660, 663, 652, 653.2, 655.1, 169.9, 236.3, 52/274, 653.1; 446/105, 106, 108
See application file for complete search history.

(56) References Cited

U.S. PATENT DOCUMENTS 2,037,736 A * 4/1936 Payne et al. ..... 403/173
2,675,895 A * 4/1954 Loewenstein ..... 52/236.3
4,904,108 A * 2/1990 Wendel ..... 403/173
5,243,940 A 9/1993 Gopel
7,310,920 B2 * 12/2007 Hovey, Jr. ..... 52/655.1

OTHER PUBLICATIONS http://www.merriam-webster.com/dictionary/unitary.*

* cited by examiner

*Primary Examiner*—David J Bagnell
*Assistant Examiner*—Sean D Andrish
(74) *Attorney, Agent, or Firm*—Sherr & Vaughn, PLLC

(57) ABSTRACT

An underground earth retention strut construction method using a horizontal frame structure is disclosed, in which since a vertical member is formed after a horizontal frame structure is first installed and completed, it is possible to minimize any interference between the vertical member and the horizontal frame structure for thereby achieving an easier construction and enhancing a construction quality. The interval of the temporary vertical member is widened during an underground excavation work, so that the ground excavation work is easy. The improved horizontal frame structure of an architecture comprises a pair of straight members which are connected by at least one plate; and a "#"-shaped connection member which is connected at a portion in which the straight members cross with each other.

18 Claims, 7 Drawing Sheets

UNDERGROUND EARTH RETENTION STRUT CONSTRUCTION METHOD USING HORIZONTAL FRAME STRUCTURE

TECHNICAL FIELD

The present invention relates to a horizontal frame structure of an architecture and a horizontal strut which is generally used for an earth retention construction for preventing a sliding of earth and sand at an excavated ground during a ground excavation construction to construct an underground floor using the horizontal frame structure, and in particular to a horizontal frame structure, which may be used for a horizontal strut, and a construction method using the same in which the use of a temporary vertical member is minimized by using a horizontal frame structure having an excellent buckling performance for dealing with an earth pressure, and a connection with a permanent vertical member (column) can be performed after an earth retention construction, and an underground excavating construction and an underground structure construction may be simplified and fast performed using a horizontal strut with respect to an earth pressure for the horizontal frame structure, so that a desired construction can be performed faster and more economically.

BACKGROUND ART

Generally, there are three representative methods for constructing an underground structure. First, in a down-top construction method, an earth retention wall is installed at a ground in which an underground structure will be built. A temporary horizontal strut is installed for dealing with an earth pressure of the earth retention wall, and a ground excavation work is performed, and a horizontal strut is installed for thereby completing an earth retention temporary construction. A main structure is installed in such a manner that a temporary structure is disassembled in a sequence from a deepest portion of an underground to the ground. Second, in a SPS (Strut as a Permanent System) construction method, an earth retention wall is installed at a ground in which an underground structure will be built, and a permanent vertical member is installed. An excavation work is performed, and a horizontal frame structure is installed. When an excavation is finished at the deepest portion of an underground, the works for a slab, concrete columns and walls are completed except for a vertical frame structure and a horizontal frame structure, and the construction is performed up to the aboveground portion. Third, in a top-down construction method, a slurry wall corresponding to an earth retention wall as well as a permanent wall structure is installed at a ground in which an underground structure will be installed, and a permanent vertical member is installed. When a horizontal frame structure and slab of a first floor of the ground are installed, an excavation is performed, and a main structure is installed. On the ground, the subsequent aboveground floor is built.

In more detail, in the above down-top construction method, a H-beam is installed at a surrounding portion of a ground in which an architecture will be built. An excavation is performed and at the same time a liner plate is installed between sheet piles, and then a girth is installed. Temporary horizontal struts are attached to the horizontal and vertical sides of a horizontal surface of the same for thereby supporting an earth pressure. In the above horizontal strut construction method, a H-beam is generally used for a temporary horizontal strut. A temporary vertical member called a center column for a connection with the H-beam is installed before a ground excavation so that the H-beam is not buckled by an earth pressure.

During the excavation, the horizontal struts are installed in a two- or three-tier structure. It is connected with a corresponding center column at every floor.

The above SPS construction method is called a permanent trust construction method. In this method, an earth retention wall is constructed, and a steel member (PRD foundation), which is a permanent vertical member and is connected with a basic pile for dealing with a weight during an underground construction work period, is installed before an excavation construction. A horizontal frame structure is installed using a H-beam at each floor for thereby forming a horizontal strut and a permanent horizontal frame structure which substantially deal with the earth pressure. At this time, in the permanent horizontal frame structure, the sizes of the related members are determined so as to substantially deal with the earth pressure of the earth retention. The permanent horizontal frame structure should be connected with the previously installed permanent vertical members. In addition, it is installed up to the aboveground portion while completing the constructions at the slab, concrete columns and walls except for the vertical member and horizontal frame structure when the excavation is performed at the deepest portion of the underground floor. Here, when the underground mat slab is completed, the steel structure can be installed at the aboveground area.

In the top-down construction method, the foundation is formed along with the slurry wall construction. In the foundation construction work, a large size through hole is formed, and a H-beam is inserted for an underground vertical member (RCD foundation), and a basic concrete is cast at the basic portions, so that a structure of a horizontal frame structure of a first floor is formed. The upper and lower sides of the same are formed in the down-top construction method and the top-down construction method for thereby forming each floor.

However, the above-described down-top construction method, SPS construction method and top-down construction method have the following problems.

In the case of the down-top construction method, the earth retention wall should be disassembled at the construction step of the underground structure of the architecture. During the disassembling work, a sudden stress unbalance may occur at the earth retention wall. A certain crisis may occur during the disassembling work. The construction is not easy due to an interference with the related structures, so that a lot of damage may occur at the materials. The period of the disassembling work is disadvantageously extended. A certain deformation may occur at a surrounding ground area, so that a peripheral structure may be affected. Since the intervals of the center columns installed for preventing the horizontal struts from being buckled are narrow, the underground excavation work generally performed by the equipments is disadvantageously affected, and the construction period is extended by an interference of the temporary members during the framework.

In the case of the SPS construction method, since the piles (PRD foundation) referred to the permanent vertical members are installed before the underground is excavated, the intervals between the piles are narrow, so that the underground excavation work is difficult. As the permanent horizontal frame structure, the H-beam is connected with the corresponding piles for thereby obtaining the operation of the horizontal strut. At this time, the piles may have construction errors, so that it is needed to actually measure the H-beam and manufacture the same, whereby the construction period is disadvantageously extended. Furthermore, the connections with the steel piles are performed by a welding method, so that it is difficult to manage the quality. In addition, as the horizontal strut, the H-beam should be capable of dealing with a high earth pressure. However, since the H-beam has a strong axis and a weak axis, the size of the member is determined by the buckling of the weak axis, so that it is needed to separately manufacture the H-beam having a wider width, whereby the size of the member is uneconomically increased. So, the width of the H-beam as the horizontal frame structure increases, so that it is not easy install the steel of the pile and the matrix which are formed with a steel and concrete structure.

In the case of the top-down construction method, since the works of the slurry wall and RCD foundation are performed only with a large size equipment, a narrow area and a not-easy-to-enter area can not be worked using the above large size equipment. Since a pile (RCD foundation) referring to a permanent vertical member is first constructed before the underground is excavated, the excavation work can not be performed since the interval between the pile is too narrow. Since the construction is performed with the top-down construction method, it is impossible to connect the previously cast upper side concrete with the concrete which will be cast at the lower side of the same. In addition, since the steel of the horizontal frame structure formed with steel concrete is interfered with the H-beam of the previously installed vertical structure, the related connection and work are difficult, and the quality management is not easy. In addition, since the vertical member installed before the excavation has a construction error, a work for compensating the error is not easy.

DISCLOSURE OF THE INVENTION

Accordingly, it is an object of the present invention to provide an underground earth retention strut construction method using a horizontal frame structure which overcome the problems encountered in the conventional art.

It is another object of the present invention to provide an underground earth retention strut construction method using a horizontal frame structure in which since a vertical member is formed after a horizontal frame structure is first installed and completed, it is possible to minimize any interference between the vertical member and the horizontal frame structure for thereby achieving an easier construction and enhancing a construction quality. The interval of the temporary vertical member is widened during an underground excavation work, so that the ground excavation work is easy.

It is further another object of the present invention to provide an underground earth retention strut construction method using a horizontal frame structure in which the horizontal frame structure may be designed to work the operation of the horizontal strut structure for thereby minimizing the use of the temporal structure, and the horizontal frame structure is formed in a certain shape, which is efficient against the buckling, so that an earth pressure can be efficiently managed. It is possible to freely select the permanent vertical member.

It is further another object of the present invention to provide a horizontal frame structure and an earth retention structure using the same, and a construction method of the same in which a construction cost decreases, and a construction quality is enhanced.

To achieve the above objects, in a horizontal frame structure of an architecture, there is provided an improved horizontal frame structure which comprises a pair of straight members which are connected by at least one plate; and a "#"-shaped connection member which is connected at a portion in which the straight members cross with each other.

To achieve the above objects, there is provided an underground earth retention strut construction method which comprises a first step in which an earth retention wall and a temporary column are installed at a surrounding portion of a ground in which an underground architecture is built; a second step in which a ground is excavated by a certain depth, and earth and sand are discharged; a third step in which a rim beam is installed at an inner side of the earth retention wall; a fourth step in which a horizontal frame structure of one among claims 1 through 8 is installed at the rim beam so that the horizontal frame structure is supported over the temporary column; a fifth step in which a ground is further excavated by a depth of one floor, and earth and sand are discharged; a sixth step in which a ground is excavated by a desired depth by sequentially repeating the third, fourth and fifth steps, and the horizontal frame structure is installed in a multiple-tier structure; a seventh step in which a mat slab is installed at a floor of the ground which is excavated through the above steps; an eighth step in which a vertical reinforcing member is installed between the connection members of the horizontal frame structure which is installed in a multiple-tier structure; a ninth step in which the temporary column is removed; and a tenth step in which a column is installed at the vertical reinforcing member, and an underground structure is built using a permanent structure along with the horizontal frame structure.

BRIEF DESCRIPTION OF THE DRAWINGS

The present invention will become better understood with reference to the accompanying drawings which are given only by way of illustration and thus are not limitative of the present invention, wherein.

MODES FOR CARRYING OUT THE INVENTION

The preferred embodiments of the present invention will be described with reference to the accompanying drawings.

Figure 1:
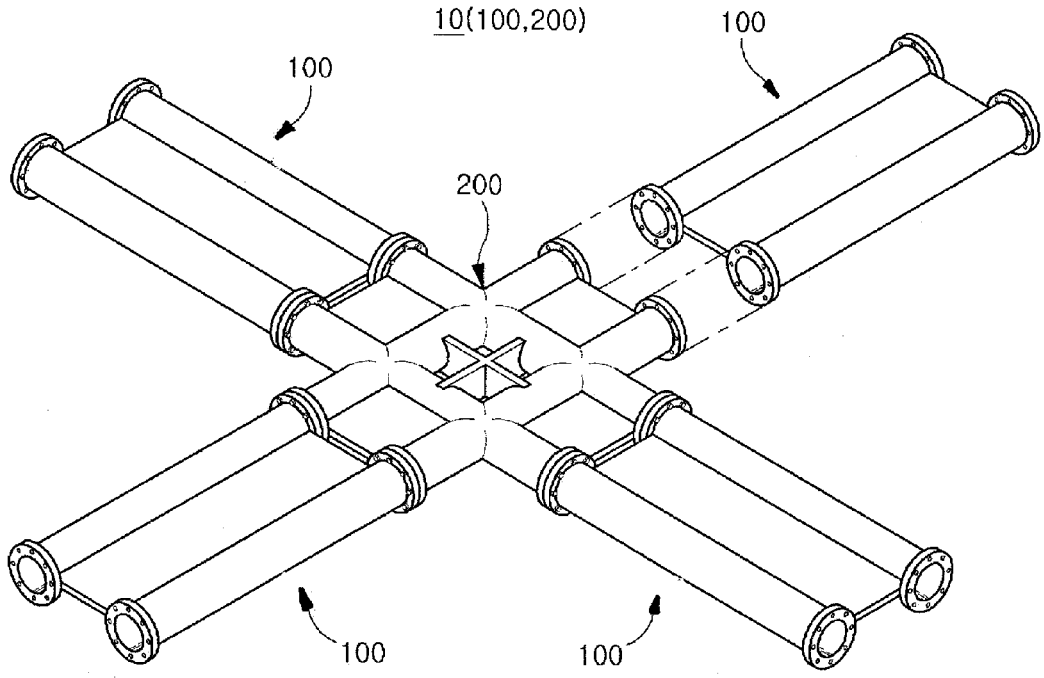
FIG. 1 is a perspective view illustrating a horizontal frame structure according to a first embodiment of the present invention.
Figure 2:
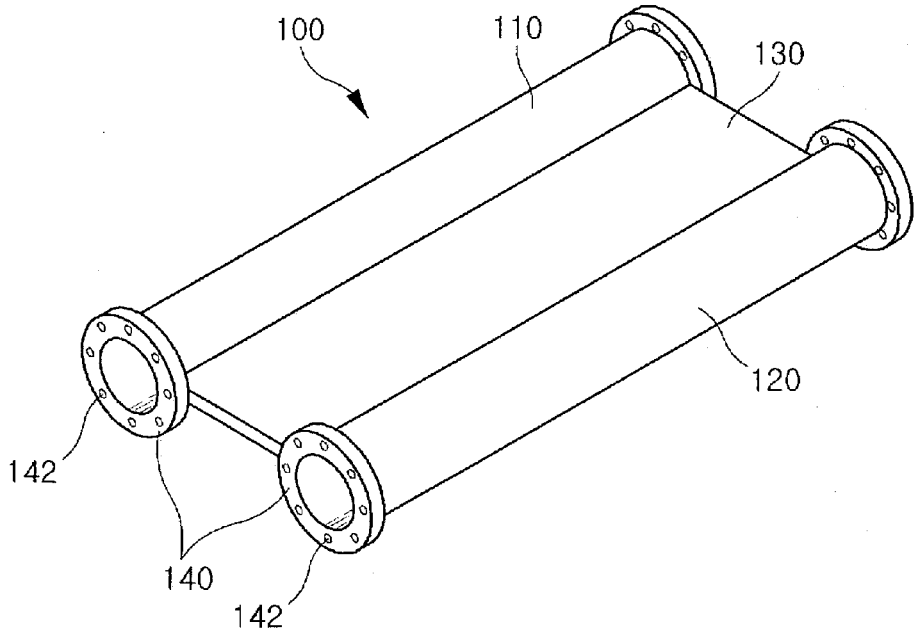
FIG. 2 is a perspective view illustrating a straight member according to a first embodiment of the present invention.
Figure 3:
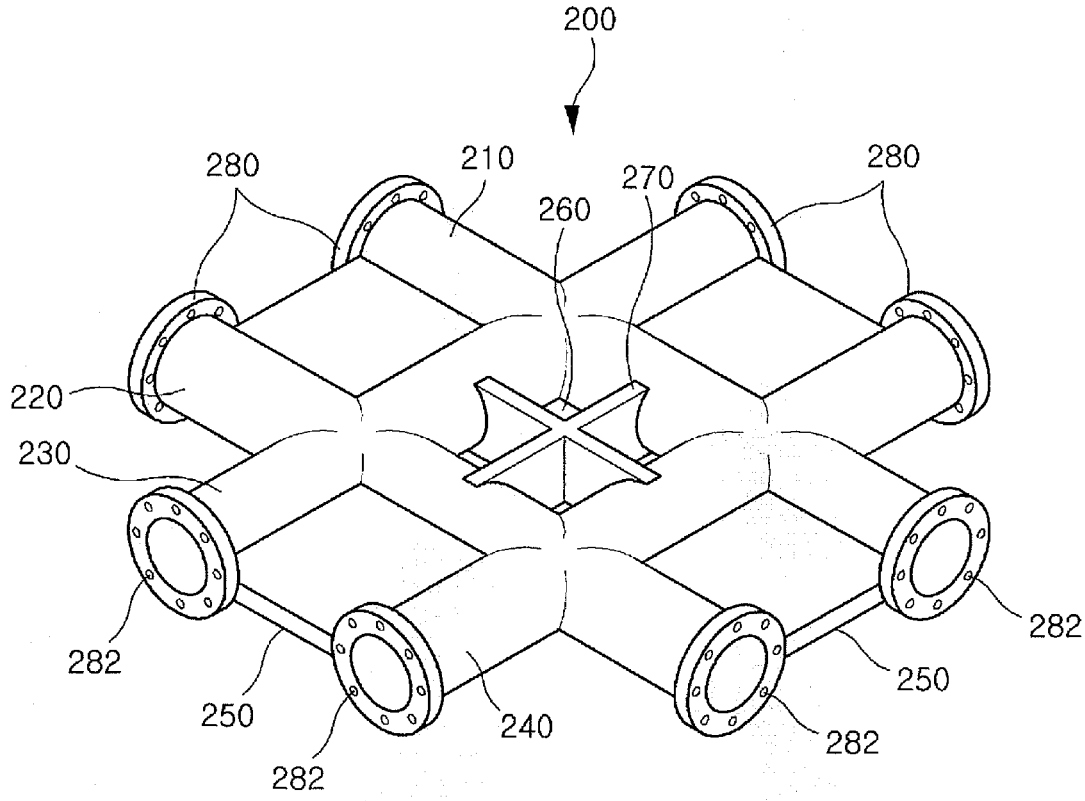
FIG. 3 is a perspective view illustrating a connection member according to a first embodiment of the present invention.

FIG. 1 is a perspective view illustrating a horizontal frame structure according to a first embodiment of the present invention, and FIG. 2 is a perspective view illustrating a straight member according to a first embodiment of the present invention, and FIG. 3 is a perspective view illustrating a connection member according to a first embodiment of the present invention.

As shown in FIG. 1, a horizontal frame structure 10 according to a first embodiment of the present invention comprises a plurality of straight members 100 for supporting an earth retention wall and preventing an excavated surface or an inclination surface from being destroyed by an earth pressure, and a connection member 200 connected at a portion in which the straight members 100 cross each other.

As shown in FIG. 2, the straight member 100 comprises a pair of pipes 110 and 120 spaced apart by a certain distance in a horizontal direction, and a plate 130 which allows the pipes 110 and 120 to be integrally formed. A flange 140 is provided at both ends of the pipes 110 and 120 for a connection with the connection member 120 of FIG. 1 or other straight members.

As shown in FIG. 3, the connection member 200 is formed in such a manner that four pipes 210 through 240 are formed in a plane #shape and cross each other at 90°. A plate 250 is provided between a pair of the pipes 210 and 220 or 230 and 240 arranged in parallel among the four pipes 210 through 240, and a through hole 260 is formed at the center portion of the same. A "+" shaped flat engaging member 270 is formed at the through hole 260 for a connection with a temporary column which supports the horizontal frame structure 10. Here, a flange 280 is formed at each end of the connection member 200 for a connection with the straight member 100 of FIG. 1 or other connection members. A pair of parallel pipes 210 and 220 or 230 and 240 are arranged at the same distances as the pipes 110 and 120 of the straight member 100 for an engagement with the straight member 100.

The neighboring straight member 100 and connection member 200 are engaged in such a manner that the flanges 140 and 280 formed at the ends come in contact with each other when being engaged with other neighboring straight members or connection members and are engaged using bolts for an easier engagement and disengagement. A plurality of engaging holes 142 and 282 are formed the flanges 140 and 280.

The pipes 110, 120, 210 through 240, which are the unit members forming the straight member 100 and the connection member 200 are formed of circular pipes which do not have weak axes and are provided with relatively high strengths with respect to all directions of axes X, Y and Z. When the horizontal frame structure 10 is installed, a non-shrinkage mortar is injected into the straight member 100 and the connection member 200, respectively, as a finishing process for thereby significantly enhancing a buckling strength in all directions. Here, the embodiment of the present invention adapts the pipes 110, 120, 210 through 240 having circular cross sections, but are not limited thereto. In some cases, they may be provided with various cross section shapes including polygons.

Figure 4:
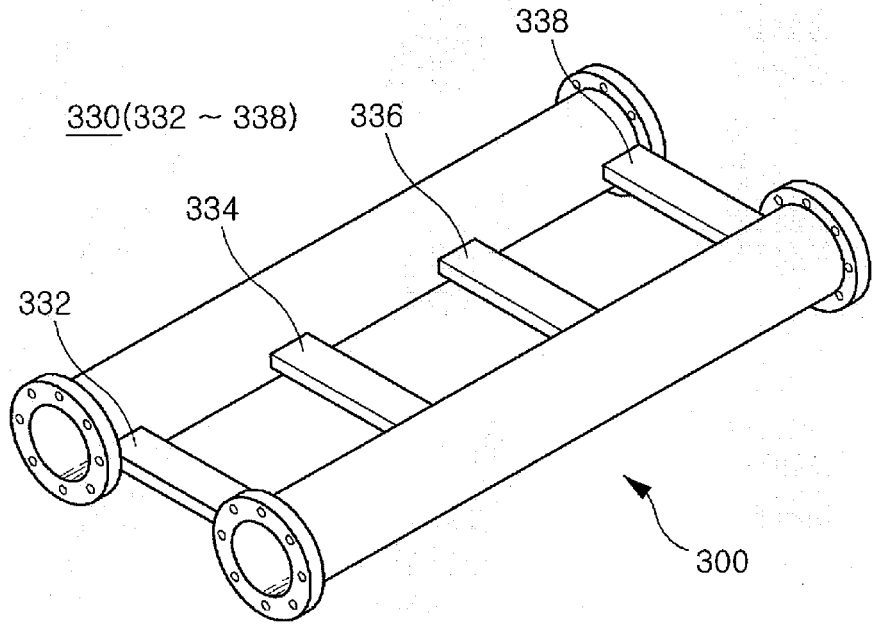
FIG. 4 is a perspective view illustrating another example of a straight member according to a first embodiment of the present invention.

FIG. 4 is a perspective view illustrating another example of a straight member according to a first embodiment of the present invention.

As shown therein, the another embodiment of the present invention has the same structure and construction as the straight member 100 of FIG. 2. A plate 330 for connecting a pair of pipes 310 and 320 is formed of at least two unit plates 332 through 338 which are spaced apart from each other. Here, the plate 330 is formed of a plurality of unit plates 332 through 338 for the reason that the weight of the straight member 100 is decreased. The use of the same may be increased or decreased based on the size of the weight applied to a pair of the pipes 310 and 320.

Figure 5:
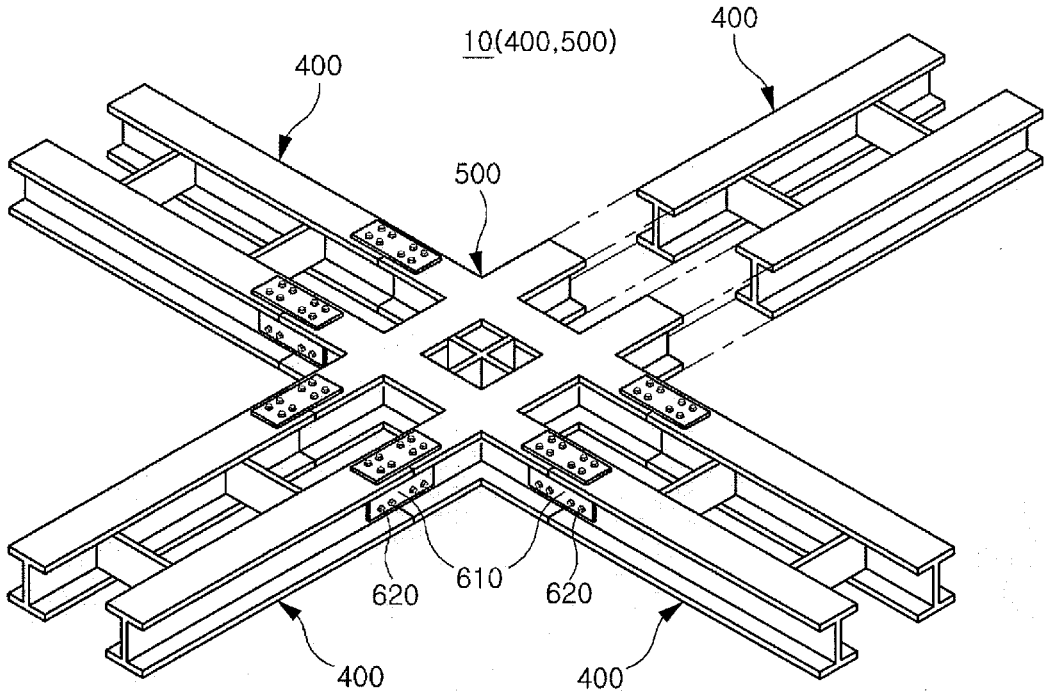
FIG. 5 is a perspective view illustrating a horizontal straight member according to a second embodiment of the present invention.
Figure 6:
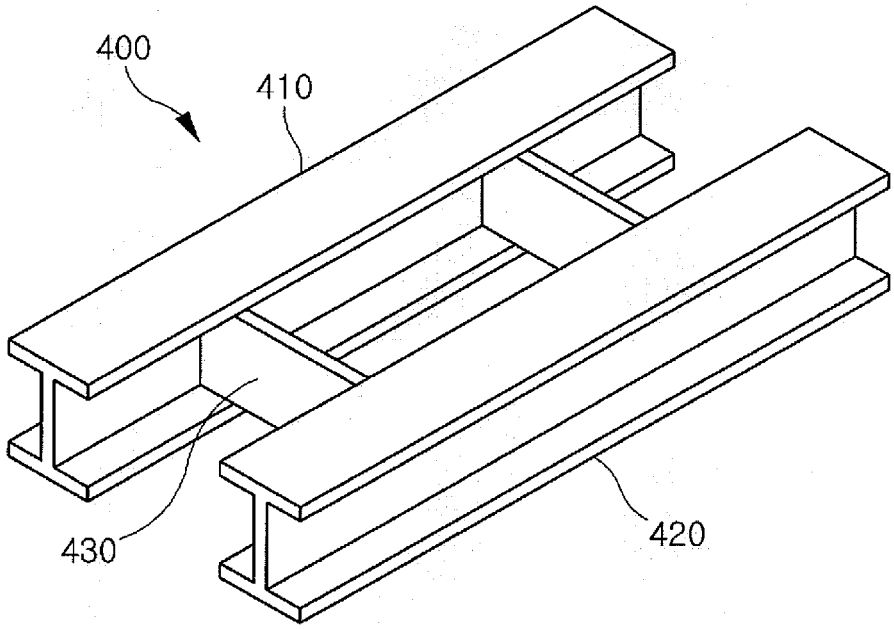
FIG. 6 is a perspective view illustrating a straight member according to a second embodiment of the present invention.
Figure 7:
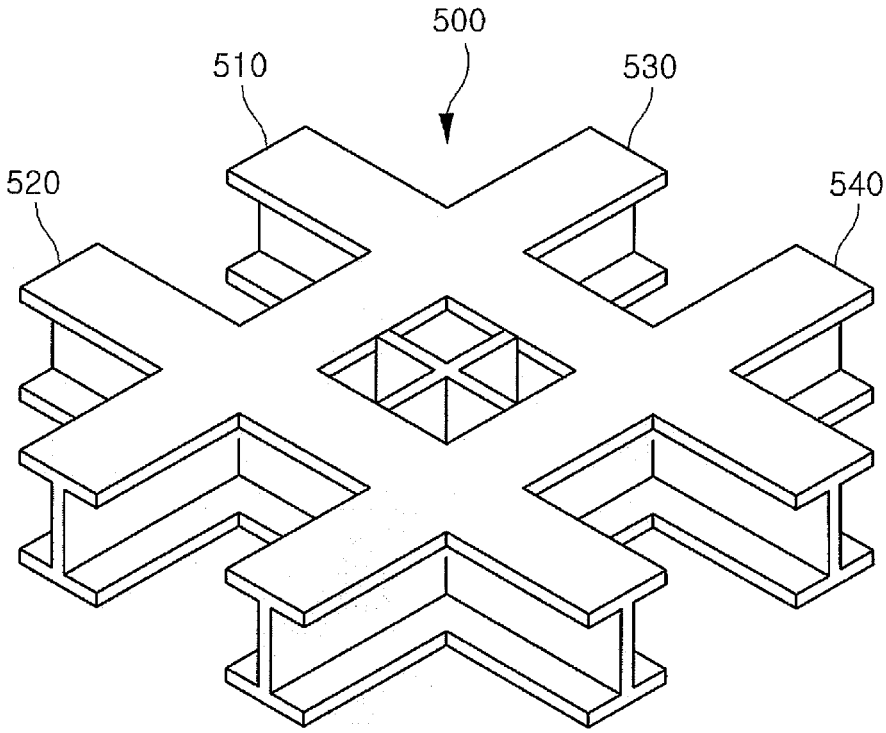
FIG. 7 is a perspective view illustrating a connection member according to a second embodiment of the present invention.

FIG. 5 is a perspective view illustrating a horizontal straight member according to a second embodiment of the present invention, and FIG. 6 is a perspective view illustrating a straight member according to a second embodiment of the present invention, and FIG. 7 is a perspective view illustrating a connection member according to a second embodiment of the present invention.

As shown in FIGS. 5 through 7, the horizontal frame structure 10 according to the second embodiment of the present invention comprises a plurality of straight members 400, and a plurality of connection members 500 which are engaged at a portion in which the straight members 400 cross each other. Namely, the second embodiment of the present invention is provided with the same construction and structure as the first embodiment of the present invention except for the construction that there are provided unit members 410, 420, 510 through 540 which form the straight member 400 and the connection member 500. In the following, only the difference between the first and second embodiments of the present invention will be described.

The unit members 410, 420, 510 through 540 forming the straight member 400 and the connection member 500 are formed of H-beams. The H-beam has a weaker strength in the direction of axis Z as compared to the axes X and Y As shown in the drawings, the axis X is connected using the plates 430 and 550, so that it is possible to overcome the above-described problems. So, in the second embodiment of the present invention, it is possible to obtain a strength similar with that of the circular cross section pipe in all directions of axes X, Y and Z.

In this embodiment of the present invention, the unit member is formed of a H-beam, but is not limited thereto. For the unit member, an I-beam, T-beam and a square shape beam may be advantageously adapted. Since the H-beam is provided with a small cross section as well as a large cross section secondary moment value, it is preferred to use the H-beam since it is more economical.

The second embodiment of the present invention, which uses the H-beam as the unit members 410, 420, 510 through 540, uses a joint plate 610 having a certain thickness and a plurality of bolts 620 when the straight member 400 and the straight member 400 are engaged, and the straight member 400 and the connection member 500 are engaged, and the connection member 500 and the connection member 500 are engaged. However, the method of engaging the beams using the joint plate 610 and the bolts 620 is a known art in the industry, so that the detailed descriptions of the same will be omitted.

FIGS. 8 through 14 are views illustrating the processes of an earth retention construction using a horizontal frame structure according to the present invention. At this time, the horizontal frame structure adapted to the process is the same as the horizontal frame structure of the first embodiment of the present invention.

Figure 8:
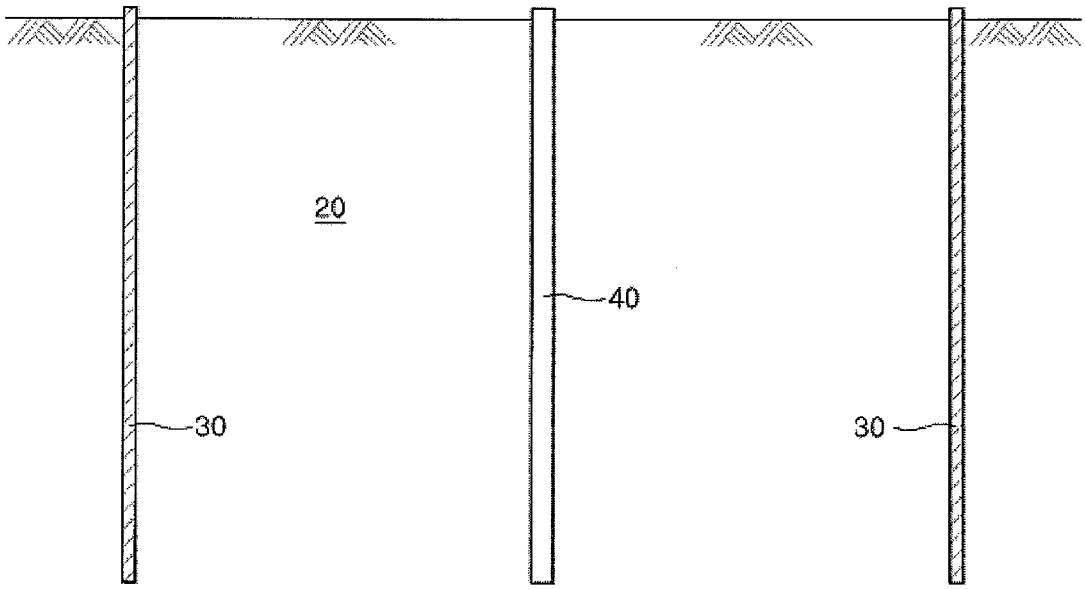
FIGS. 8 through 14 are views illustrating the processes of an earth retention construction using a horizontal frame structure according to the present invention.
Figure 9:
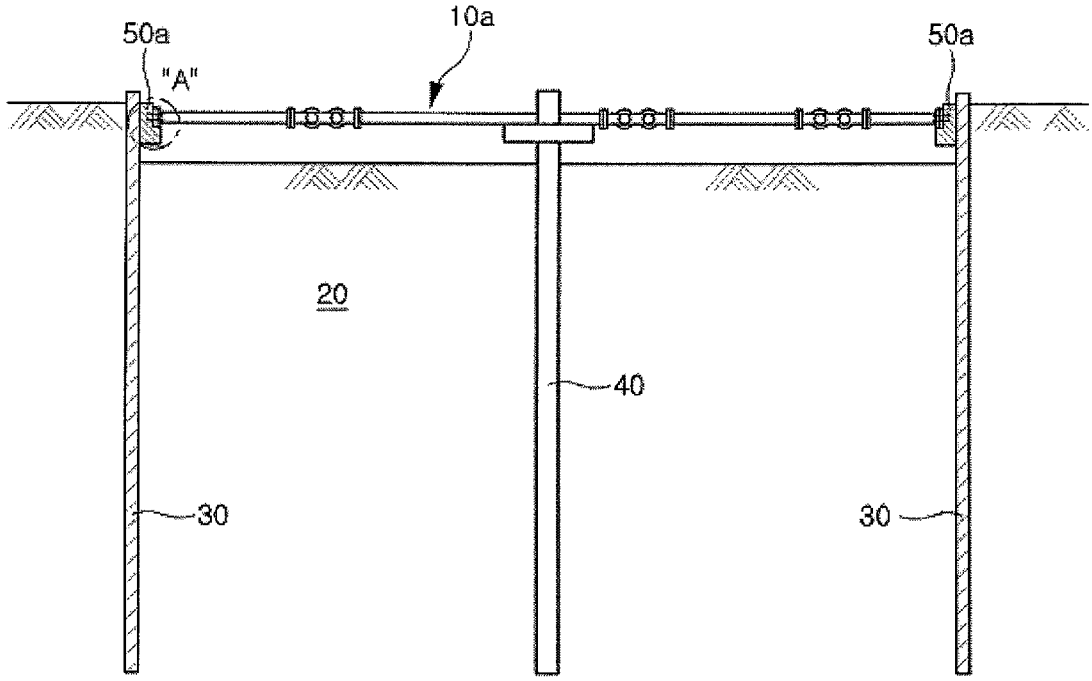
Figure 10:
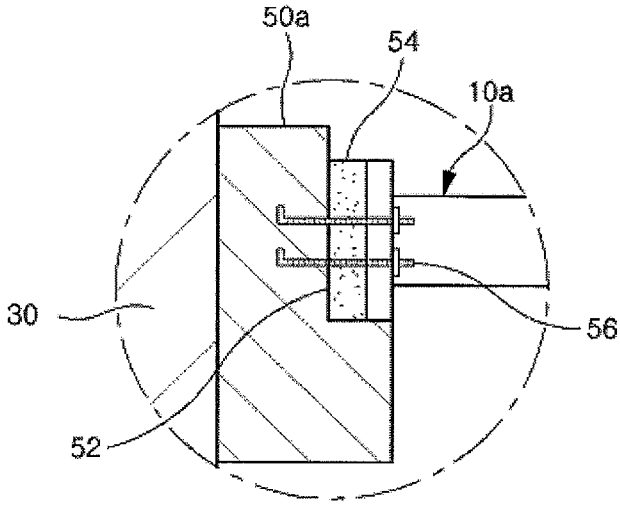

An earth retention wall 30 is installed at a surrounding portion of a ground 20 in which an underground architecture will be installed as shown in FIG. 8. A temporary column 40 is installed for enhancing a strength of a foundation ground and supporting a horizontal frame structure installed on the same. When the installations of the earth retention wall 30 and the temporary column 40 are finished, as shown in FIG. 9, the ground is excavated by the depth of the first floor of the underground, and earth and sand are discharged. A rim beam 50 is installed along an inner wall surface of the earth retention wall 30 in a horizontal direction, and a horizontal frame structure 10*a* is installed between the rim beams 50, which are installed opposite to each other. The horizontal frame structure 10*a* is supported over the center pile 40.

At this time, an engaging shoulder 52 having vertical and horizontal surfaces is installed at the rim beam 50 for compensating a length error of the horizontal frame structure 10*a*. The distance of the vertical surface of the engaging shoulder 52 formed at a pair of the rim beams 50 is set longer than the length of the horizontal frame structure 10*a* for thereby compensating a length error of the horizontal frame structure 10*a* which may occur during the manufacture. For example, when the horizontal frame structure 10*a* is mounted between the engaging shoulders 52, a certain gap is formed between the vertical surface of the engaging shoulder 52 and a cross section portion of the horizontal frame structure 10*a*. A non-shrinkage mortar 54 is filled in the above gap, and the horizontal frame structure 10*a* is fixed using an angle bolt 56 for thereby compensating a length error of the horizontal frame structure 10*a* and fixing the horizontal frame structure 10*a*.

Figure 11:
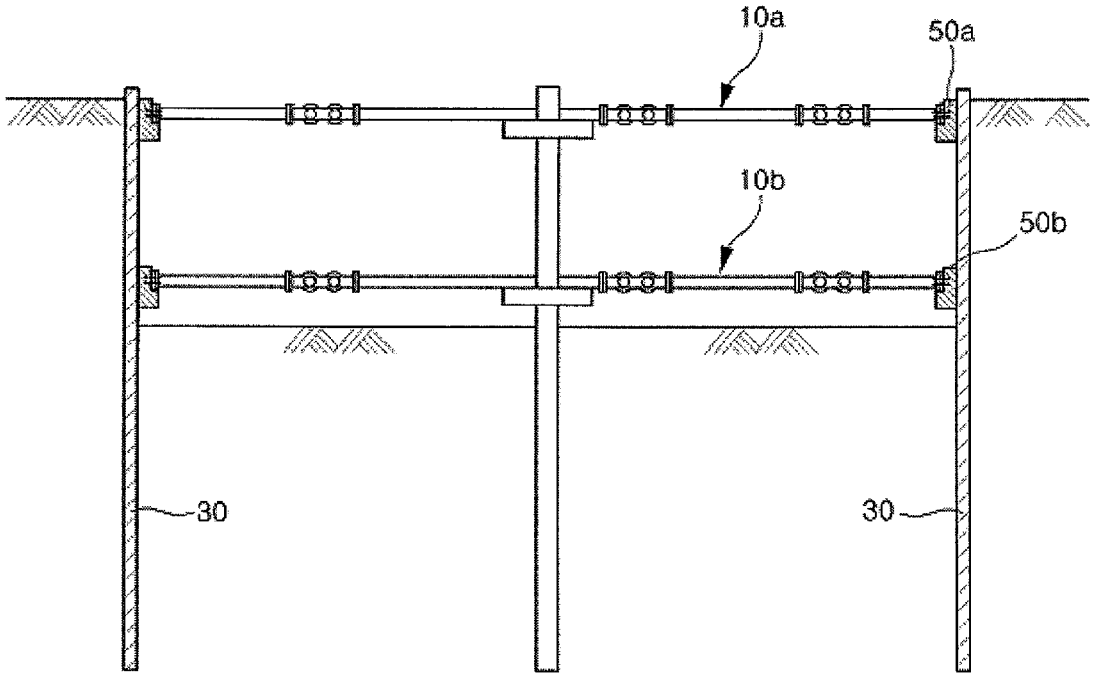

When the installation of the horizontal frame structure 10 is finished with the repetition of the above processes, as shown in FIG. 11, the ground is excavated by the depth of the first floor of the underground, and earth and sand are discharged. A new rim beam 50*b* and a horizontal frame structure 10*b* are installed at the inner wall surface of the earth retention wall 30 of the excavated ground. Here, the rim beam 50*b* and the horizontal frame structure 10*b* are spaced apart from the rim beam 50*a* and the horizontal frame structure 10*a*, which are installed at the lower side of the aboveground first floor, at a certain distance in the vertical direction.

Figure 12:
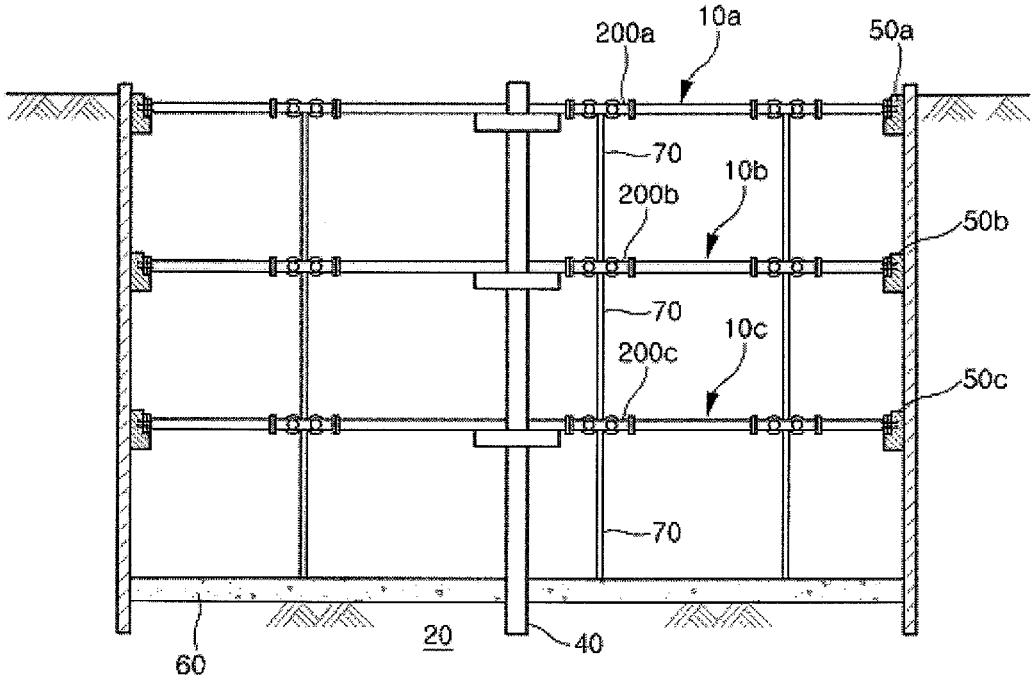
Figure 13:
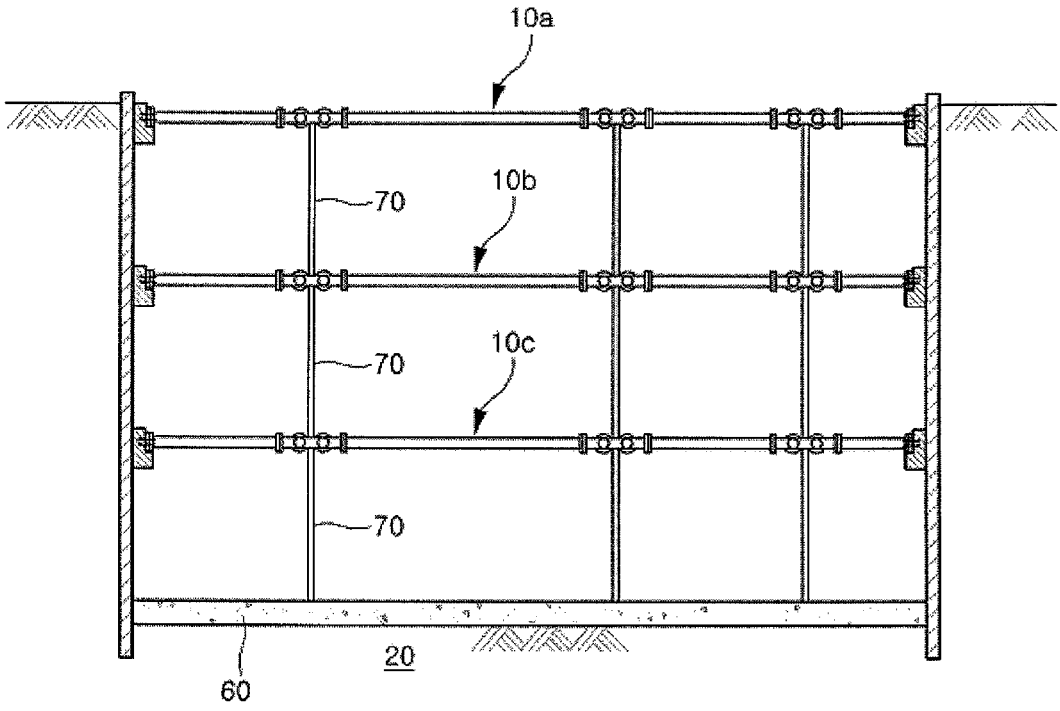

The above-described processes are repeatedly performed, so that as shown in FIG. 12, the excavation is performed at the third floor of the underground, and then the horizontal frame structure 10*c* is installed. A mat slab 60 is cast at the floor of the ground 20 using steel concrete. A vertical reinforcing member 70 is installed between the connection members 200*a*, 200*b* and 200*c* of the horizontal frame structure 10*a*, 10*b* and 10*c*. As shown in FIG. 13, the temporary column 40 is removed. Here, the vertical reinforcing member 70 is provided for preventing the horizontal frame structures 10*a*, 10*b* and 10*c* from being sagged, respectively. It may be used as a column of the permanent structure later.

Figure 14:
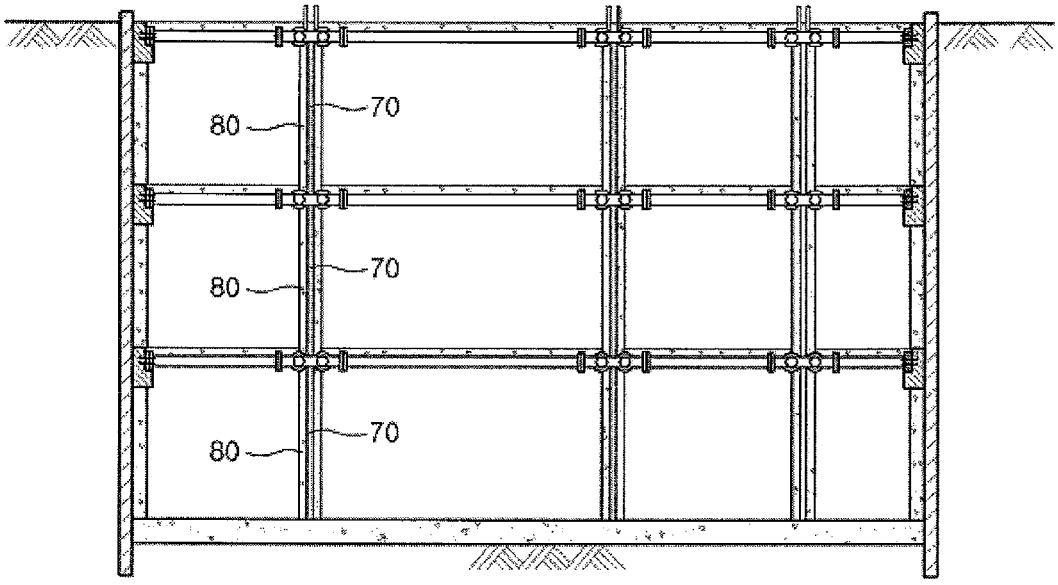

As shown in FIG. 14, the column 80 is installed at the vertical reinforcing member 70, and the underground structure is formed using the horizontal frame structures 10*a*, 10*b* and 10*c*, so that all processes are finished.

As described above, in the horizontal frame structure and the underground earth retention strut construction method using the same according to the present invention, since the horizontal members having no weak axes are used, a buckling reliability with respect to the axes X, Y and Z is very high, so that it is possible to minimize the use of the temporary vertical members during the installations of the earth retention structures.

In addition, since the use of the vertical members is minimized, and the inner space of the earth retention structure is expanded, a ground excavation work is easy. Since the horizontal strut is formed of a permanent structure, not the temporary structure, it is not needed to install along the permanent structure, so that the work is decreased. Furthermore, a construction inconvenience occurring due to an overlapped structure of the temporary structures and permanent structures can be eliminated in the present invention.

The present invention may be well applicable to the top-down construction method and down-top construction method which are known as a common construction method for building the underground architecture. The construction period may be advantageously decreased in the present invention.

The horizontal frame structure and the construction and process of the underground earth retention strut construction method using the same according to the present invention are illustrated in the drawings along with the above descriptions.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. An architectural frame structure comprising:

a single, one piece, unitary connection member having a plurality of end portions extending from each side of the single, one piece, unitary connection member including first and second end portions extending in parallel from a first side of the single, one piece, unitary connection member, third and fourth end portions extending in parallel from a second side of the single, one piece, unitary connection member, fifth and sixth end portions extending in parallel from a third side of the single, one piece, unitary connection member and seventh and eighth end portions extending in parallel from a fourth side of the single, one piece, unitary connection member; and a plurality of straight members including first and second straight members connected to and extending from the first and second end portions, respectively, third and fourth straight members connected to and extending from the third and fourth end portions, respectively, fifth and sixth straight members connected to and extending from the fifth and sixth end portions, respectively, and seventh and eight straight members connected to and extending from the seventh and eight end portions, respectively, wherein each straight member extends from the respective end portion in such a manner that each straight member and the respective end portion contact each other at adjacent ends thereof.

2. The architectural frame structure of claim 1, wherein the single, one piece, unitary connection member has a through hole at a central portion thereof.

3. The architectural frame structure of claim 2, further comprising an engaging member provided at the through hole.

4. The architectural frame structure of claim 1, wherein each end portion comprises an H-beam.

5. The architectural frame structure of claim 1, wherein each straight member comprises an H-beam.

6. The architectural frame structure of claim 1, wherein the first and second straight members are connected by a pair of parallel extending and spaced apart unit plates.

7. The architectural frame structure of claim 1, wherein the third and fourth straight members are connected by a pair of parallel extending and spaced apart unit plates.

8. The architectural frame structure of claim 1, wherein the fifth and sixth straight members are connected by a pair of parallel extending and spaced apart unit plates.

9. The architectural frame structure of claim 1, wherein the seventh and eight straight members are connected by a pair of parallel extending and spaced apart unit plates.

10. The architectural frame structure of claim 1, further comprising a joint plate which connects each straight member to a respective end portion.

11. An architectural frame structure comprising:

a single, one piece, unitary connection member including an engaging member provided at a central portion thereof, first and second end portions extending in parallel in a first direction, third and fourth end portions extending in parallel in a second direction, fifth and sixth end portions extending in parallel in a third direction and seventh and eighth end portions extending in parallel in a fourth direction, wherein the first and third directions are perpendicular to the second and fourth directions, respectively; and a plurality of straight members including first and second straight members connected to and extending from the first and second end portions, respectively, third and fourth straight members connected to and extending from the third and fourth end portions, respectively, fifth and sixth straight members connected to and extending from the fifth and sixth end portions, respectively, and seventh and eight straight members connected to and extending from the seventh and eight end portions, respectively, wherein each straight member extends from the respective end portion in such a manner that each straight member and the respective end portion contact each other at adjacent ends thereof.

12. The architectural frame structure of claim 11, wherein each end portion and each straight member comprises an H-beam, respectively.

13. The architectural frame structure of claim 11, wherein:

the first and second straight members are connected by a pair of first unit plates;

the third and fourth straight members are connected by a pair of second unit plates;

the fifth and sixth straight members are connected by a pair third unit plates; and the seventh and eight straight members are connected by a pair of fourth unit plates.

14. The architectural frame structure of claim 11, further comprising a joint plate which connects each straight member to the respective end portion.

15. An architectural frame structure comprising:

a connection member having a single, one piece, unitary structure including first and second connection member portions extending in parallel in a first direction from the connection member, third and fourth connection member portions extending in parallel in a second direction from the connection member, fifth and sixth connection member portions extending in parallel in a third direction from the connection member and seventh and eighth connection member portions extending in parallel in a fourth direction from the connection member, wherein the first and third directions are perpendicular to the second and fourth directions, respectively;

a plurality of straight members including first and second straight members connected to the first and second connection member portions, respectively, and extend from the first and second connection member portions in such a manner that adjacent ends thereof contact each other, third and fourth straight members connected to the third and fourth connection member portions, respectively, and extend from the third and fourth connection member portions in such a manner that adjacent ends thereof contact each other, fifth and sixth straight members connected to the fifth and sixth connection member portions, respectively, and extend from the fifth and sixth connection member portions in such a manner that adjacent ends thereof contact each other, and seventh and eight straight members connected to the seventh and eight connection member portions, respectively, and extend from the seventh and eighth connection member portions in such a manner that adjacent ends thereof contact each other;

a pair of first unit plates which connect the first and second straight members to each other;

a pair of second unit plates which connect the third and fourth straight members to each other;

a pair third unit plates which connect the fifth and sixth straight members to each other; and a pair of fourth unit plates which connect the seventh and eight straight members to each other.

16. The architectural frame structure of claim 15, wherein the connection member further comprises an engaging member provided at a central portion thereof.

17. The architectural frame structure of claim 15, wherein each end portion comprises an H-beam.

18. The architectural frame structure of claim 15, wherein each straight member comprises an H-beam.

* * * * *